US005369885A

United States Patent [19]

Ferraro

[11] Patent Number: 5,369,885

[45] Date of Patent: Dec. 6, 1994

[54] INSERT MOLDED DYNAMIC SHAVING SYSTEM

[75] Inventor: Frank A. Ferraro, Trumbull, Conn.

[73] Assignee: Warner-Lambert Company

[21] Appl. No.: 236,862

[22] Filed: May 2, 1994

Related U.S. Application Data

[63] Continuation of Ser. No. 973,468, Nov. 9, 1992, abandoned.

[51] Int. Cl.[5] ..... B26B 21/06

[52] U.S. Cl. ..... 30/41; 30/50; 30/77; 30/87

[58] Field of Search ..... 30/41, 50, 51, 57, 77, 30/79, 87, 47

[56] References Cited

U.S. PATENT DOCUMENTS

| | | | |
|---|---|---|---|
| 4,378,634 | 4/1983 | Jacobson | 30/77 |
| 4,443,940 | 4/1984 | Francis et al. | 30/50 |
| 4,554,735 | 11/1985 | Chen | 30/47 |
| 4,932,123 | 6/1990 | Francis | 30/50 |
| 5,038,472 | 8/1991 | Iderosa | 30/51 |
| 5,056,222 | 10/1991 | Miller et al. | 30/41 |
| 5,074,042 | 12/1991 | Althaus et al. | 30/50 |
| 5,084,969 | 2/1992 | Althaus | 30/79 |
| 5,224,267 | 7/1993 | Simms et al. | 30/50 |

*Primary Examiner*—Richard K. Seidel
*Assistant Examiner*—Hwei-Siu Payer
*Attorney, Agent, or Firm*—Charles W. Almer, III

[57] ABSTRACT

A wet-shaving razor unit having at least one vertically-displaceable blade responsive to forces encountered during shaving. The razor unit also includes laterally-disposed vertical return springs extending from and continuous with both ends of the razor unit for supporting the blade. The return springs allow vertical displacement of the blade in response to forces encountered during shaving and return the blade to a resting position in the absence of such forces.

21 Claims, 11 Drawing Sheets

INSERT MOLDED DYNAMIC SHAVING SYSTEM

This application is a continuation of U.S. patent application Ser. No. 07/973,468 filed on Nov. 9, 1992 now abandoned.

BACKGROUND OF THE INVENTION

The present invention relates to an insert molded dynamic shaving system and, more particularly, to an insert molded wet-shaving razor unit having at least one vertically-displaceable blade responsive to forces encountered during shaving.

Wet-shaving razor units, which include disposable razors and cartridges, are well known in the art. These units are typically of the twin-blade design, that is, each razor unit includes both a seat blade and a cap blade. It is believed in the shaving industry that the use of two blades provides a smoother, closer shave.

Of the various wet-shaving razor units known in the art, at least one device is designed to allow vertical movement of the blades (and also of the guard bar) in response to forces encountered during shaving. Such a device is disclosed in U.S. Pat. No. 4,492,024, assigned to The Gillette Company, and commonly referred to in the commercial market as THE SENSOR ®.

In particular, the '024 device is a complex assembly of a plurality of intricately-cooperating components. Once assembled, the blades (along with the guard bar) are disposed within vertical guide slots provided in the razor frame and rest on and are supported by a plurality of spring fingers, which are connected to the razor frame. The spring fingers upwardly bias the blades and guard bar and, additionally, accommodate vertical movement of these components in response to forces encountered during shaving. Clamps, which are wrapped around both ends, retain the components within such device.

As is known to those skilled in the art, the production of a device, such as the one disclosed in the '024 patent, requires a plurality of fabrication processes and assembly steps. Each process and/or step translates into time and manufacturing cost. Additionally, the many required processes and steps result in a multitude of manufacturing tolerances. It is apparent to those skilled in the art that the tolerances associated with a design employing a plurality of discrete intricately-cooperating components is of the utmost importance. In this respect, measures taken to ensure that the components are made within prescribed limits further increase the cost of producing such devices. Moreover, deviation from these required fine tolerances will normally result in a substandard product.

There is therefore a need in the art for a wet-shaving razor unit of a design allowing vertical displacement of the blades and guard bar in response to forces encountered during shaving, yet, at the same time, overcoming the manufacturing drawbacks/costs associated with the prior art devices. Similarly, there is a need in the art for a method for producing such a razor unit.

SUMMARY OF THE INVENTION

The present invention, which addresses the problems associated with the prior art, is a wet-shaving razor unit for effective shaving of a contoured surface. The razor unit includes at least one vertically-displaceable blade extending along the length of the unit. The razor unit also includes laterally-disposed vertical return springs extending from both ends of the razor unit for movably supporting the blade.

Preferably, the laterally-disposed vertical return springs are continuous with the ends of the razor unit. These return springs allow vertical displacement of the blade in response to forces encountered during shaving and return them to its original position in the absence of such forces.

Preferably, the blade includes a vertically-disposed portion and an angled portion having a cutting edge for shaving. In a preferred embodiment, the vertically-disposed portion is encased in a thermoplastic material along the longitudinal length of the blade. The vertical return springs are integrally formed and continuous with the encased vertically-disposed portion of the blade. The cutting edge of the blade is preferably encased with thermoplastic material at each of its outer ends. In a preferred embodiment, the angled portion of the blade is substantially encased in thermoplastic material. In this embodiment, the cutting edge of the blade extends outward from the encased angled portion to allow shaving.

The razor unit also preferably includes a vertically-displaceable guard bar extending along the length of the unit. In a preferred embodiment, the razor unit includes a vertically-displaceable seat blade and a vertically-displaceable cap blade.

In an alternative embodiment of the present invention, the razor unit includes at least one insert having at least one vertically-displaceable blade. The insert includes laterally-disposed vertical return springs extending from both ends for movably supporting the blade. The razor unit also includes a shell configured to receive the insert. Preferably, the laterally disposed vertical return springs are continuous with the ends of the insert.

The present invention is also directed to a method for molding a wet-shaving razor unit having at least one vertically-displaceable blade extending along the length of the razor unit and also having a cutting edge for shaving. The method includes the step of supporting the blade in a mold with the cutting edge surrounded by mold members arranged to remain out of contact with the edge. The method also includes the step of injecting a thermoplastic material into the mold whereby the razor unit is formed around the blade with the cutting edge free from contact with the thermoplastic material. In this step, laterally-disposed vertical return springs extending from and continuous with both ends of the razor unit for supporting the blade are formed.

In an additional preferred embodiment, the method includes the step of forming a vertically-displaceable guard bar extending along the length of the unit. The razor unit is preferably formed with a vertically-displaceable seat blade and a vertically-displaceable cap blade.

As a result, a wet-shaving razor unit of a design allowing vertical displacement of the blade(s) and guard bar in response to forces encountered during shaving is provided. The preferred embodiment of the wet-shaving razor unit is an integral/continuous thermoplastic body in which the blade(s) is movably supported on both ends by a molded laterally-disposed vertical return spring. The design of the unit allows such unit to be manufactured in a single step, thereby reducing the overall manufacturing cost (because many of the additional processes/steps required by the prior art device have been eliminated) and also reducing the multitude of components requiring manufacturing tolerances. Consequently, the razor unit can be repeatedly produced on a commercial scale with a high degree of predictability.

DETAILED DESCRIPTION OF THE INVENTION

Figure 1:
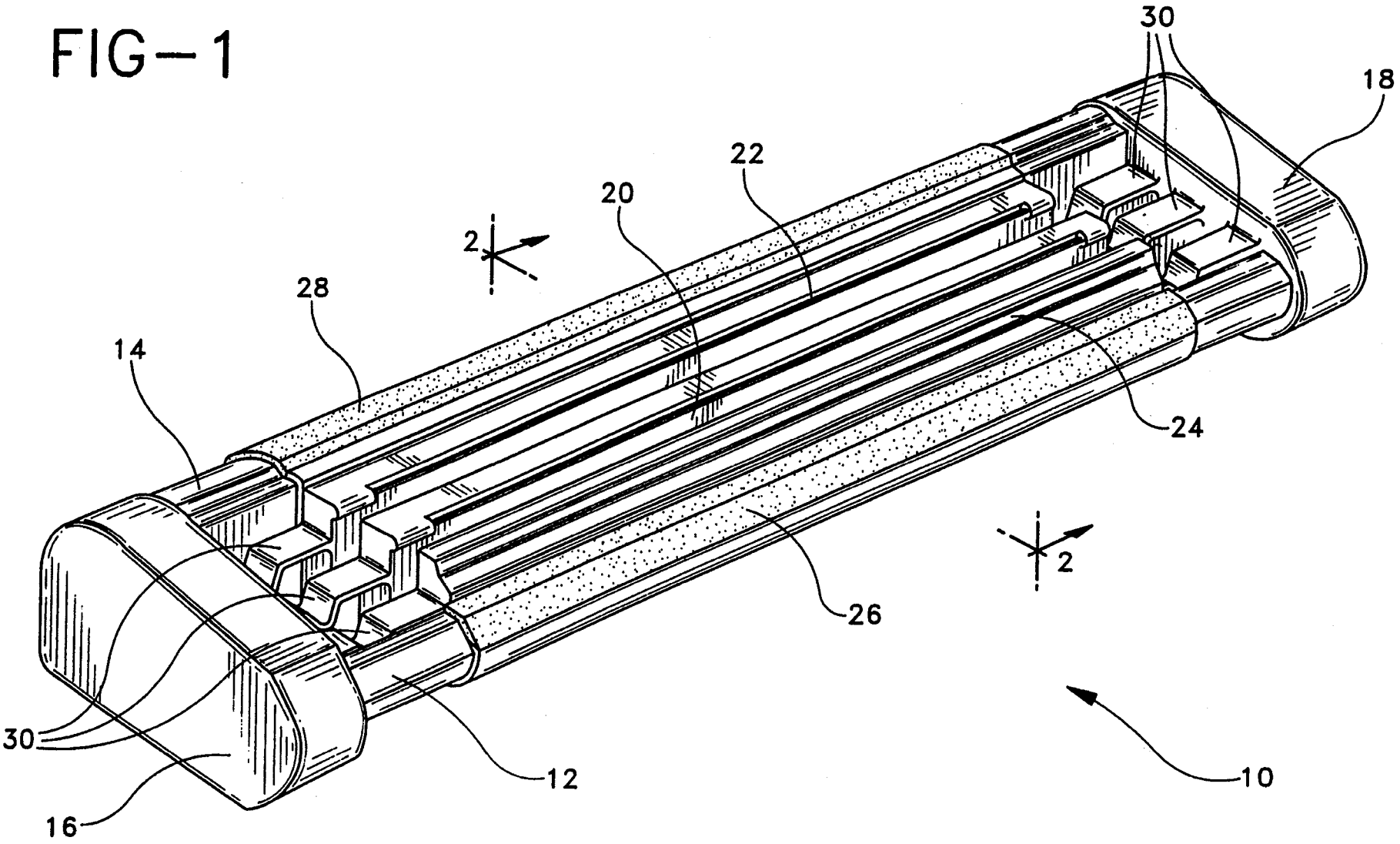
FIG. 1 is a perspective view of the wet-shaving razor unit of the present invention.

Referring to the drawings and, in particular to FIG. 1, a twin-blade, wet-shaving razor unit 10 is shown. Razor unit 10 includes a seat portion 12, a cap portion 14 and ends 16, 18. The razor unit also includes a vertically-displaceable seat blade 20 and a vertically-displaceable cap blade 22. Each of the blades includes a cutting edge extending along the longitudinal length of the blade. Finally, the razor unit includes a vertically-displaceable guard bar 24 and shaving aids 26, 28 attached to the seat and cap portion, respectively. These shaving aids may be formed from various polymeric materials known to those in the shaving industry, e.g., polyethylene oxide, which has been found to provide desirable lubricity to shaving devices during wet-shaving.

The guard bar, seat blade and cap blade are supported on each end by laterally-disposed vertical return springs 30, which allow vertical displacement of the blades (and guard bar) in response to forces encountered during shaving and return the blades (and guard bar) to a resting position in the absence of any such forces. Laterally-disposed vertical return springs 30 extend laterally from ends 16, 18 of wet-shaving razor unit 10 and, in a preferred embodiment, are continuous with such ends, as shown in FIG. 1.

Figure 2:
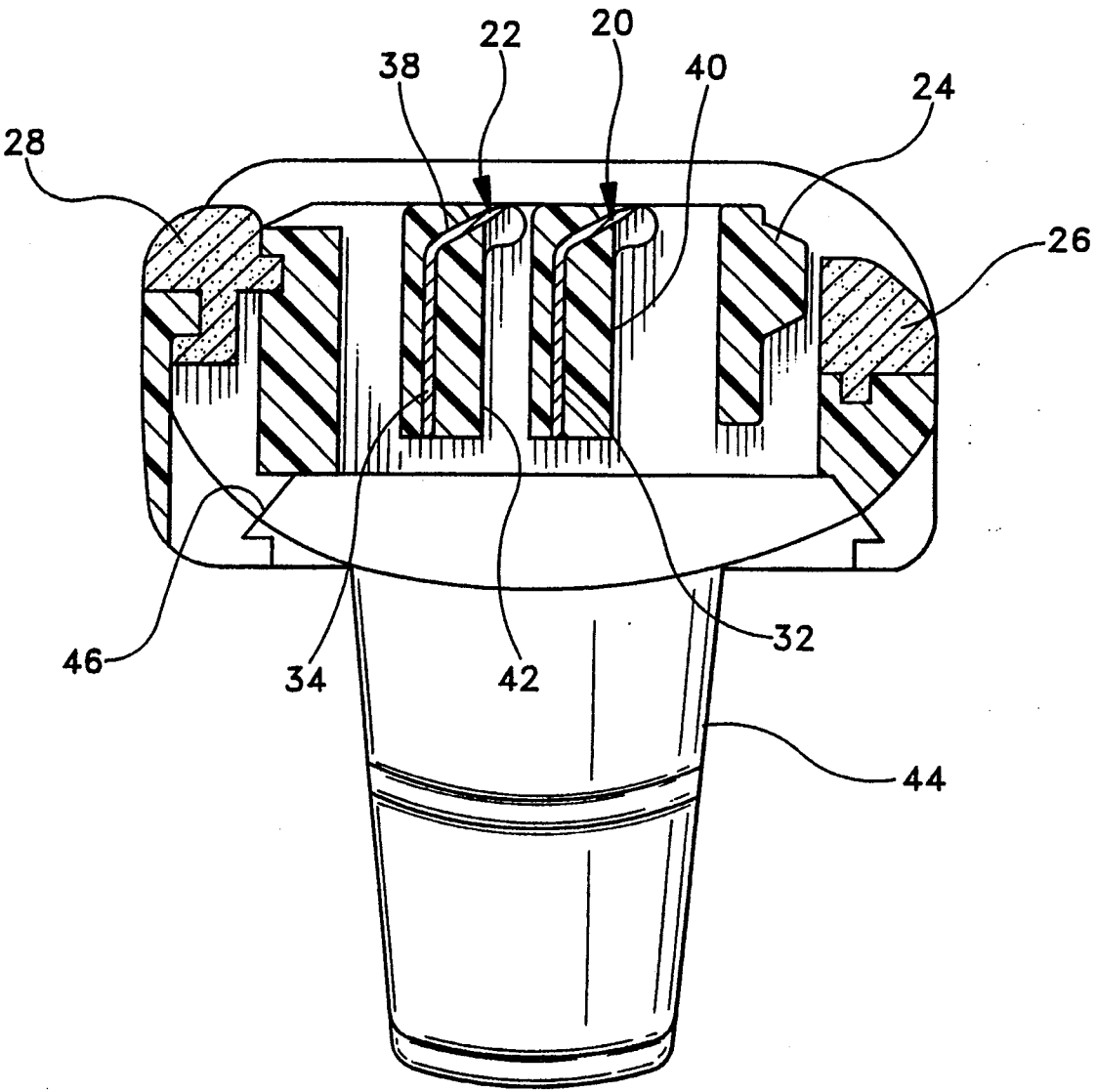
FIG. 2 is a cross-sectional view taken along lines 2—2 of FIG. 1.

Referring to FIG. 2, the seat and cap blades each include a vertically-disposed portion 32, 34, respectively and an angled portion 36, 38, respectively. As is readily seen, the blades are substantially encased in rectangular blocks 40, 42 of thermoplastic material. In fact, all of the vertically-disposed portion and the vast majority of the angled portion of each of the blades is encased in such plastic. Only a part of the angled portion of the blades, which includes the cutting edge, extends outward from the rectangular block of plastic. It is also readily seen in FIG. 2 that guard bar 24 is a continuous, thermoplastic body.

Figure 2A:
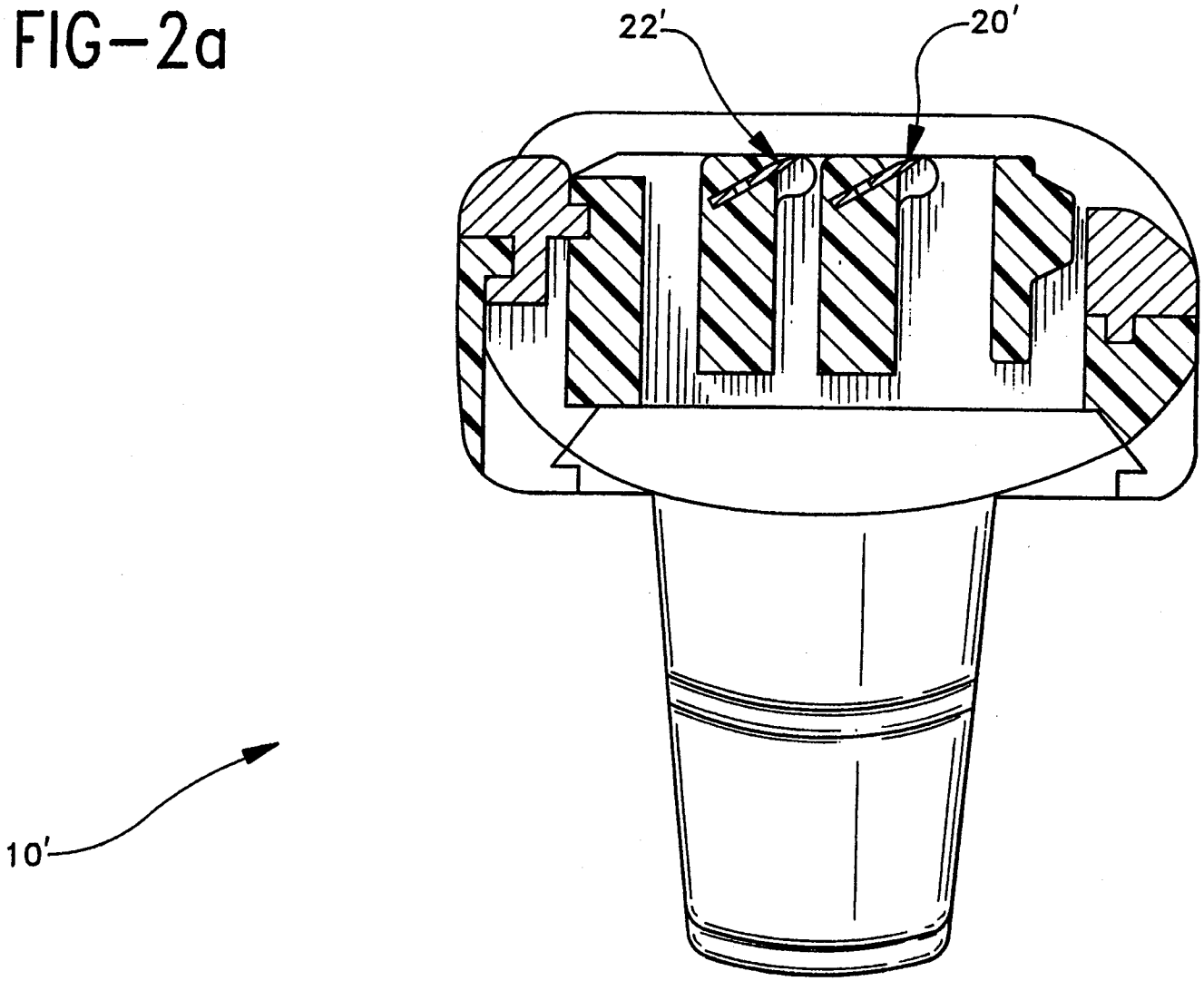
FIG. 2*a* is a cross-sectional view similar to FIG. 2 showing an alternative blade arrangement.

An alternative blade arrangement is illustrated in FIG. 2*a*. In this embodiment of the present invention, razor unit 10' is similar in all respects to razor unit 10 except that blades 20' and 22' have been substituted for blades 20 and 22, respectively.

Figure 3:
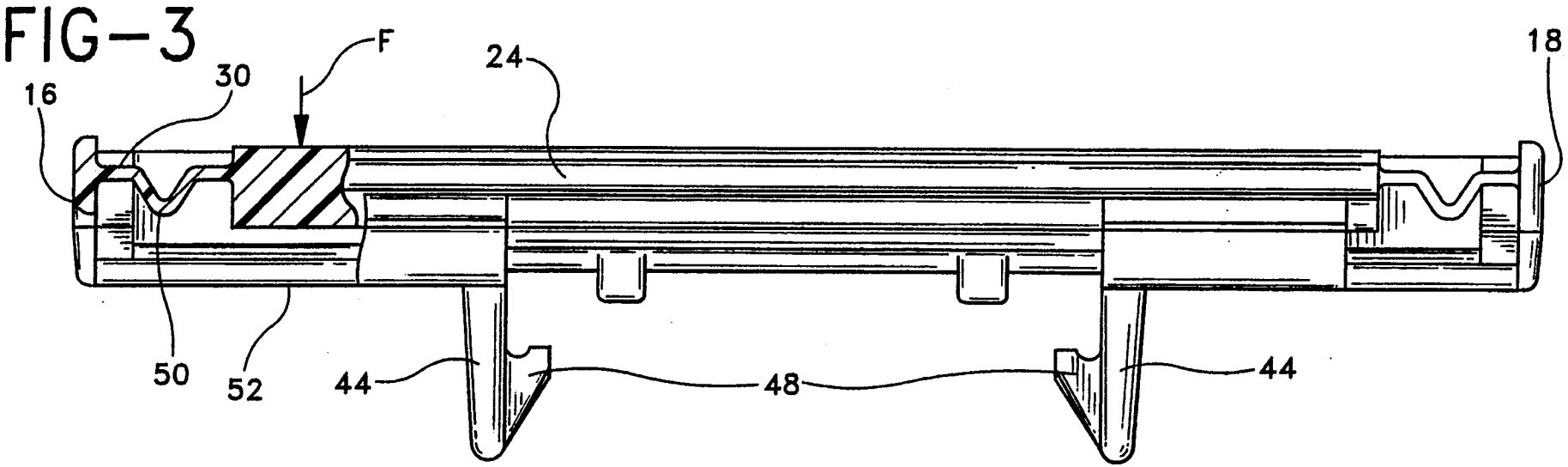
FIG. 3 is a front-elevational view, in partial section, of the razor unit of the present invention.
Figure 4:
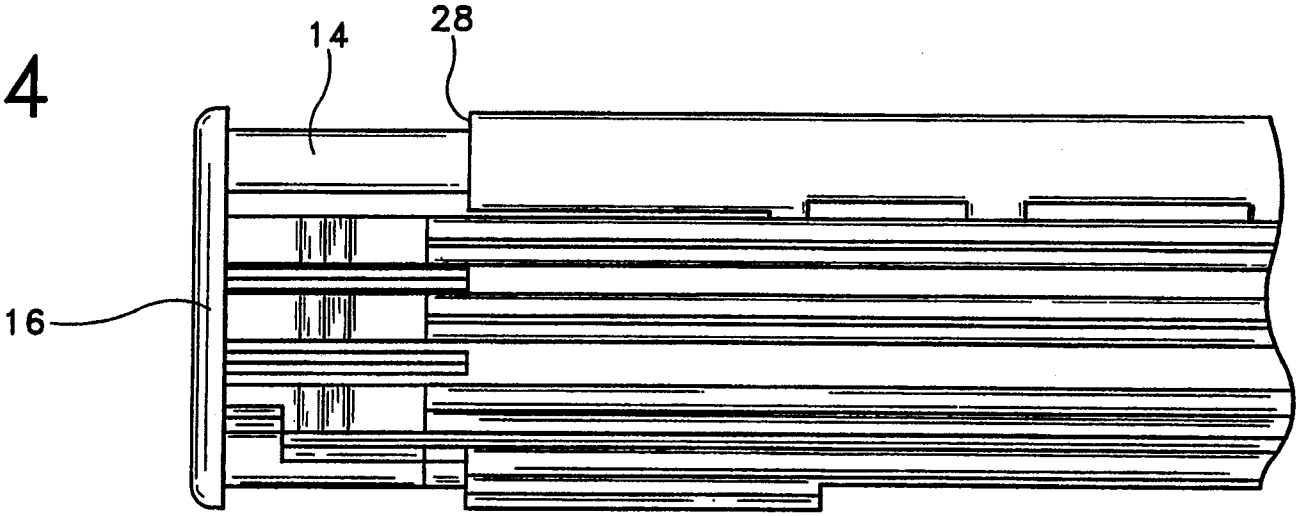
FIG. 4 is a partial top plan view of the present invention.

Razor unit 10 also includes a handle-receiving bracket 44 that engages with a chambered slot 46 formed in the bottom surface of the razor unit. The bracket, as shown in FIG. 3, includes arms 48 configured to engage with a handle (not shown). Such a handle may be designed to either fixedly maintain the razor unit or to allow "pivoting" of the razor unit during shaving. (The term "pivoting" refers to movement of the razor unit about an axis parallel to the cutting edge of the blade.)

In FIG. 3, guard bar 24 is partially broken away to show the laterally-disposed vertical return spring supporting the end of the encased seat blade. Each of the return springs is formed with a flexible hinge 50 to facilitate vertical displacement of the blades and guard bar. More particularly, assuming a force F is applied to the seat blade (as shown in FIG. 3), flexible hinge 50 will allow the encased seat blade to travel downward, i.e., towards bottom surface 52 of the razor unit, and will, additionally, return the encased seat blade to its "at rest" position after force F is removed.

Figure 5:
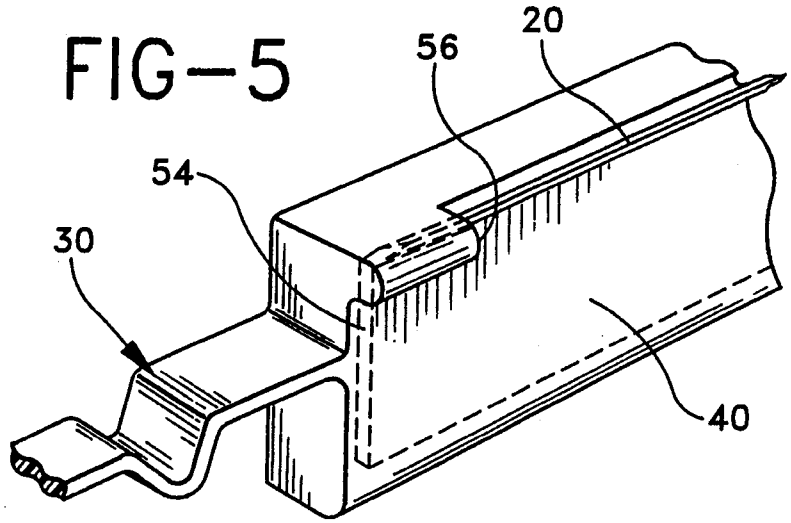
FIG. 5 is an enlarged detail of FIG. 1 showing the encased seat blade.

Referring to FIG. 5, a portion of the encased seat blade, along with one of the laterally-disposed vertical return springs, is shown. (The encased cap blade is identical in structure and design and need not be described separately.) As shown, the blade is substantially encased in plastic (i.e., in rectangular block 40) such that only a part of the blade, which includes the cutting edge, protrudes outward from the thermoplastic block. Near the ends of the blade (for example, near end 54 of seat blade 20), the cutting edge is encased, in a "bump" 56 of thermoplastic material so that the corner tip of the blade, which is typically quite sharp, is not exposed to the user. Alternatively, this corner tip could be "rounded off," thereby eliminating the need for encasing the cutting edge of the blade with a "bump" of plastic near its outer ends.

Figure 6:
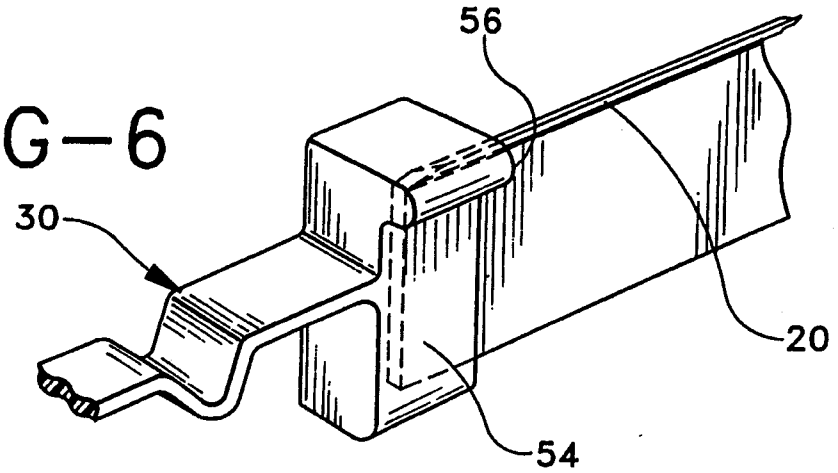
FIG. 6 is an enlarged detail similar to FIG. 5 showing an alternative embodiment of the present invention.

In another embodiment of the invention, as shown in FIG. 6, the blades are not encased in thermoplastic material along their entire length; instead, only the ends of the blades are encased with plastic, which is sufficient to both support the blade and provide a plastic body to which the return spring may be joined. In similar fashion to the embodiment illustrated in FIG. 5, the cutting edge of the blades near the blades outer ends (e.g., outer end 54) may be encased in bump 56 of thermoplastic material (as shown in FIG. 6) to protect the user from the corner tip of the blade or, alternatively, the corner tip may be "rounded off," thereby eliminating the need for encasing the cutting edge of the blade near its outer ends.

Figure 7:
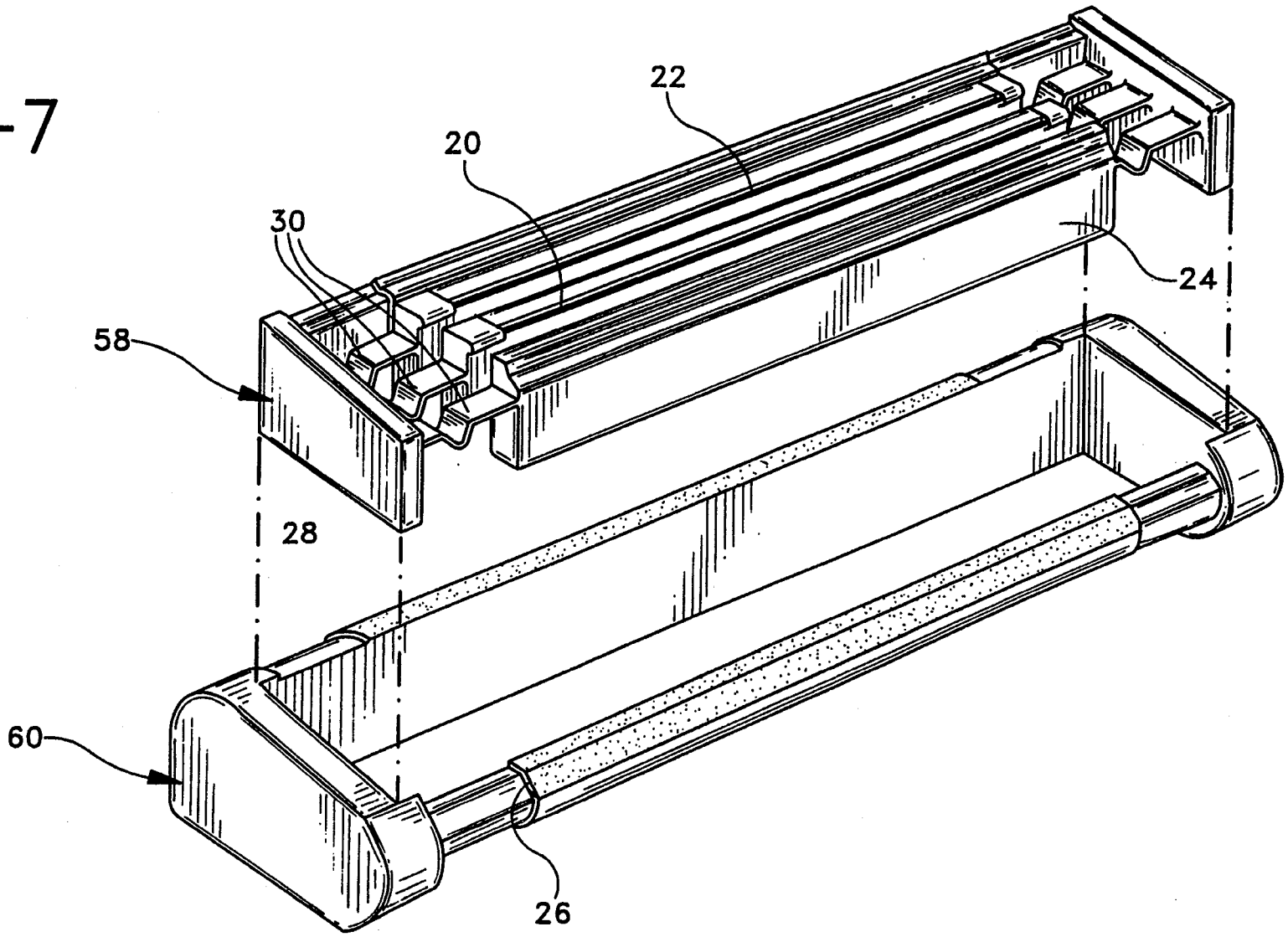
FIG. 7 is another alternative embodiment of the present invention in which an insert is fitted into a shell.

In an additional embodiment, as illustrated in FIG. 7, an insert 58, including seat blade 20, cap blade 22 and guard bar 24, is formed separate from the body or shell of the razor unit. Insert 58 includes laterally-disposed vertical return springs 30, which function as described above. After insert 58 is formed, it is inserted into outer shell 60, which is fabricated separately and includes shaving aids 26, 28. Once assembled, the embodiment of FIG. 7 functions in the same manner as razor unit 10 illustrated in FIG. 1.

Figure 8:
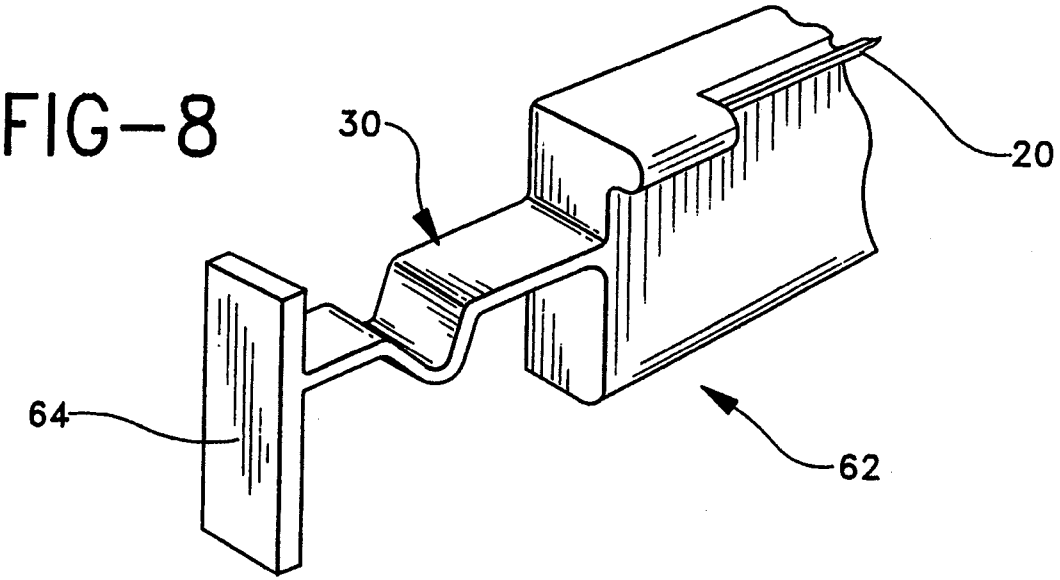
FIG. 8 is a further alternative embodiment of the present invention in which a blade insert is formed with rails on both ends.

Alternatively, as shown in FIG. 8, a blade insert 62 may be formed separate from the razor unit. Blade insert 62 includes a rail 64, which is dimensioned to be received by a slot formed in the razor unit. Although only the seat blade assembly is illustrated, a cap blade insert and a guard bar insert could be formed in a similar manner.

Figure 9:
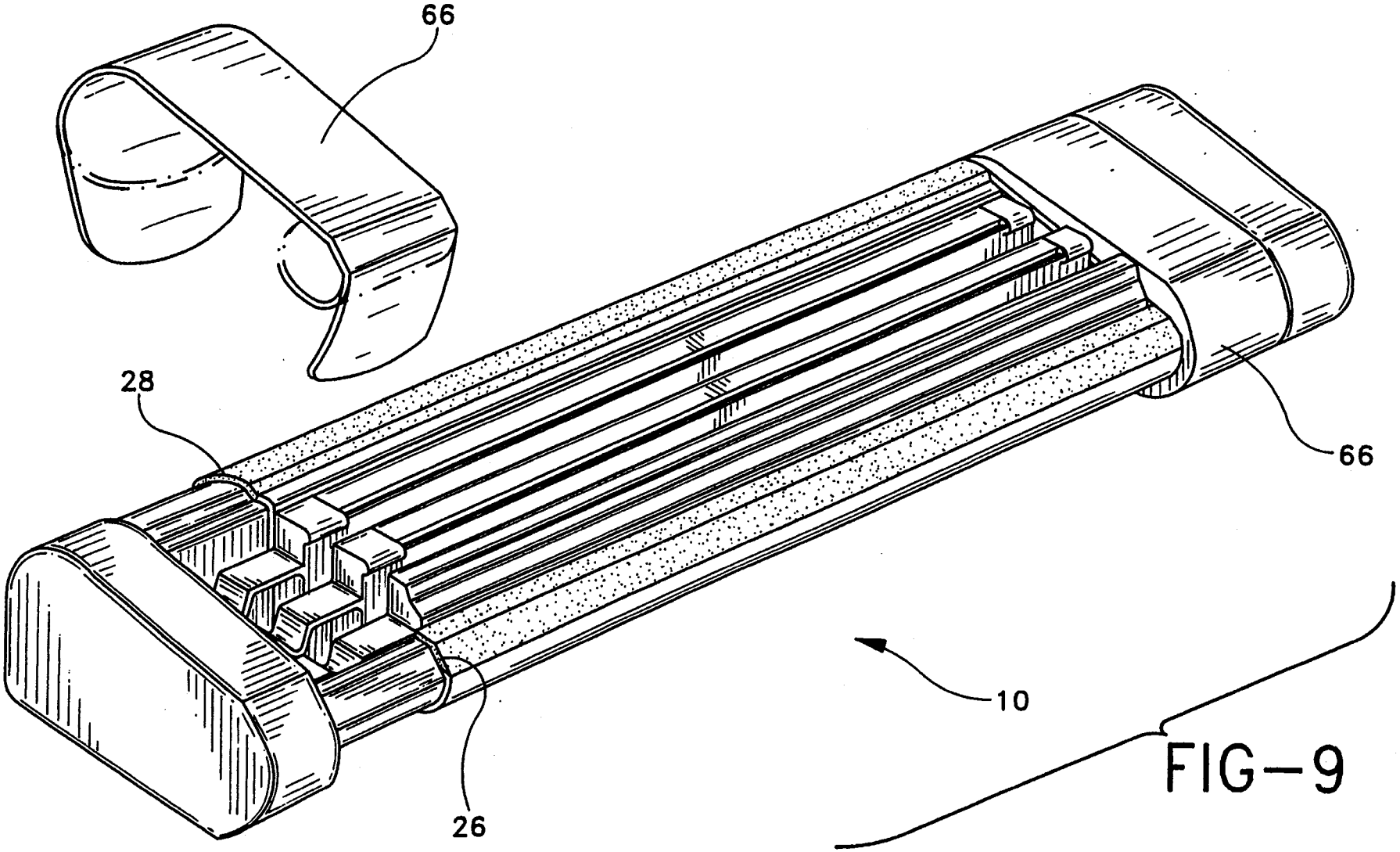
FIG. 9 is still another alternative embodiment of the present invention employing closure clips for enclosing the outer ends of the razor unit.

Referring to FIG. 9, razor unit 10 may include closure clips 66 for enclosing the ends of the razor unit. Closure clips 66 may be employed with the present invention for the purpose of protecting return springs 30 during shaving. Closure clips 66 may also be employed to apply a downwardly-directed force to the blades such the blades become upwardly biased.

As described (and as shown in FIGS. 1, 2, 2*a*, 7, and 9), the present invention includes shaving aids 26, 28. In the described embodiment, shaving aid 26 is positioned forward of the seat blade, while shaving aid 28 is positioned rearward of the cap blade. Alternatively, only one shaving aid could be employed, such shaving aid being positioned in either of the indicated positions.

Figure 10:
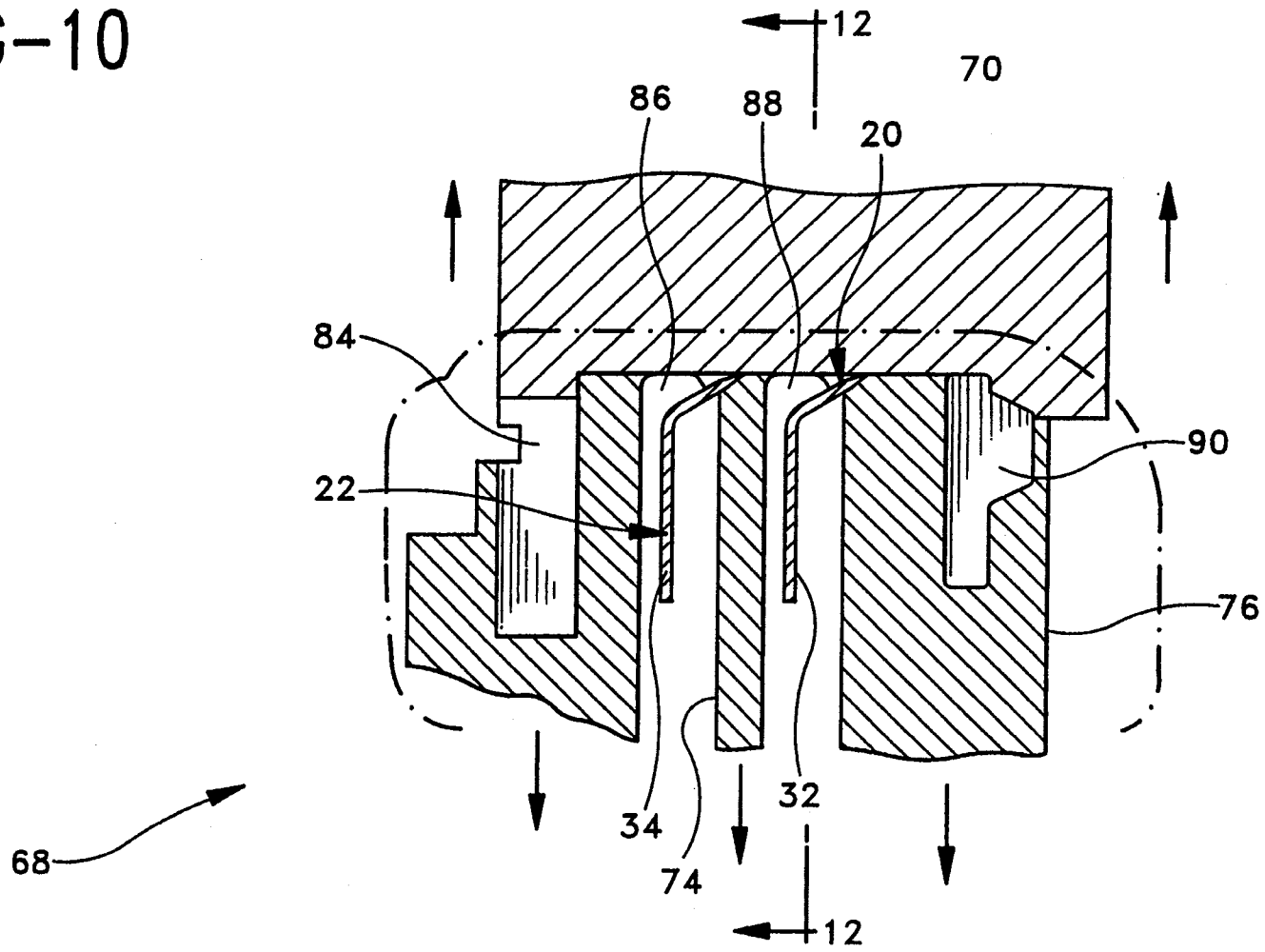
FIG. 10 is a cross-sectional view taken through the mold employed to form the razor unit of the present invention.

The disclosed razor unit may be formed through an insert molding procedure. Referring to FIG. 10, such an insert molding procedure will require a mold 68 having mold members 70, 72, 74 and 76. The mold members should be movable with respect to blades 20 and 22. For example, each of the mold members may be movable in the directions indicated in FIG. 10.

The initial step of the insert molding procedure will involve positioning the blades in the mold in proper orientation with respect to each other. In this regard, it may be necessary to support the blades at points along the vertically-disposed portion (i.e., portion 32 or 34). Following positioning of the blades, the mold members are moved into the position shown in FIG. 10. Mold members 70, 74 and 76 are configured to house the cutting edges of the blades during molding, thereby protecting such edges from the injected thermoplastic material.

Figure 11:
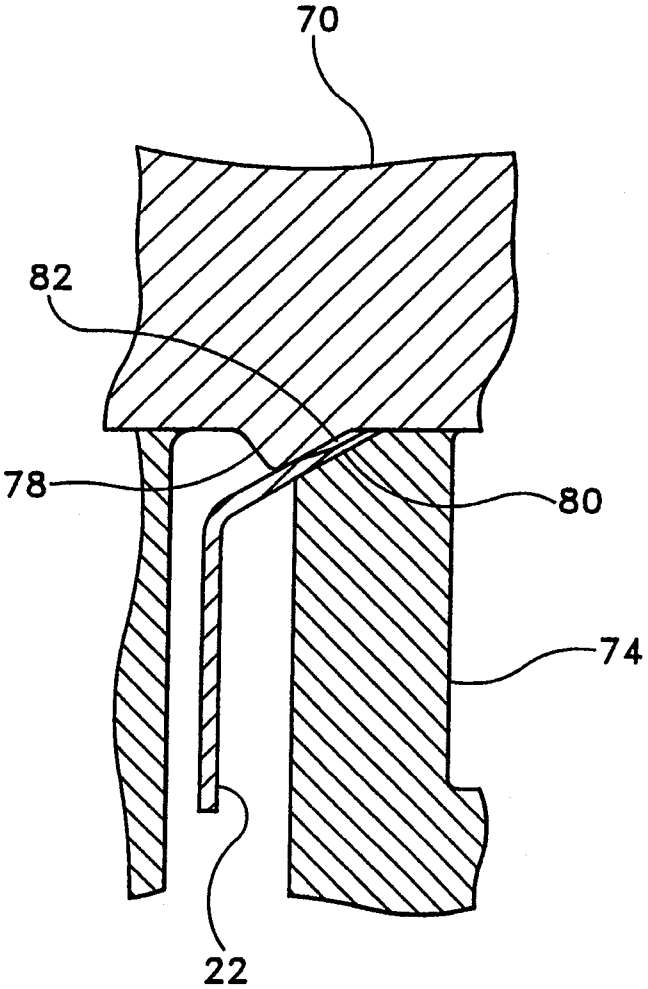
FIG. 11 is an enlarged detail of FIG. 10.

As best shown in FIG. 11, mold members 70 and 74 are configured such that the cutting edge of blade 22 is sheltered by the mold members during molding. More particularly, the cutting edge is trapped between a triangular dimple 78 formed on mold member 70 and a chamfered edge 80 of mold member 74. As a result, the cutting edge is safely positioned within cavity 82 during the molding procedure. (The cutting edge of blade 20 is housed in a similar fashion during molding by mold members 70 and 76.)

After the blades and mold members are properly positioned (i.e., once the mold is closed), thermoplastic material is injected into the mold. The thermoplastic material fills the open areas of the mold (e.g., cavities 84, 86, 88 and 90 shown in FIG. 10) thereby forming the razor unit. A polymeric material may also be injected into the mold to form shaving aids 26, 28. After the thermoplastic material has set, the mold is opened and the formed razor unit is removed.

Figure 12:
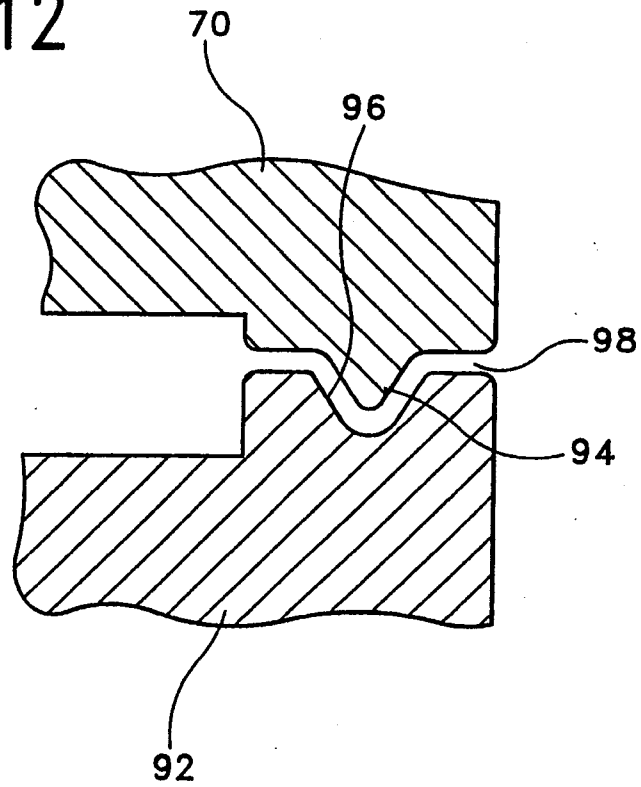
FIG. 12 is a cross-sectional view taken along lines 12—12 of FIG. 10.

Referring to FIG. 12, mold 68 includes additional mold members (e.g., mold member 92) that form vertical return springs 30. Alternatively, one of the mold members necessary to form the return springs may be incorporated into mold member 70. In this regard, mold member 70 is configured with a triangular protrusion 94. Opposite triangular protrusion 94 is a triangular recess 96 formed in mold member 92. When the mold is closed, cavity 98 is formed, which after injection of the thermoplastic material, will form vertical return spring 30.

Figure 13:
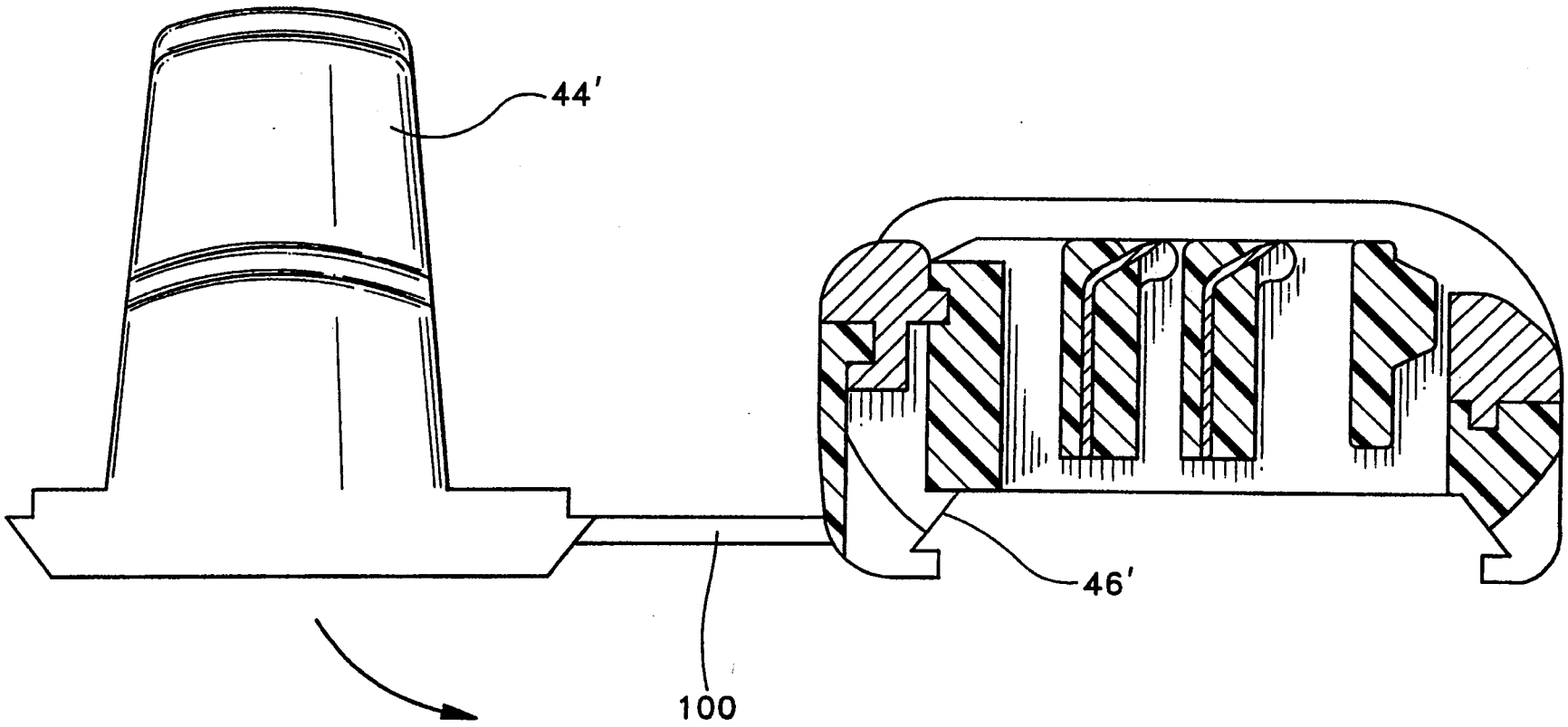
FIG. 13 is an alternative embodiment of the present invention in which the handle-receiving bracket is molded in a hinged manner to the razor unit.

In a preferred embodiment of the present invention (as shown in FIG. 13), the razor unit is simultaneously molded with handle-receiving bracket 44'. More particularly, bracket 44' is molded such that it is hinge mounted to the razor unit. After molding, bracket 44' is rotated clockwise about the hinge until the bracket engages chamfered slot 46'. Hinge 100 may or may not be subsequently discarded.

Figure 14:
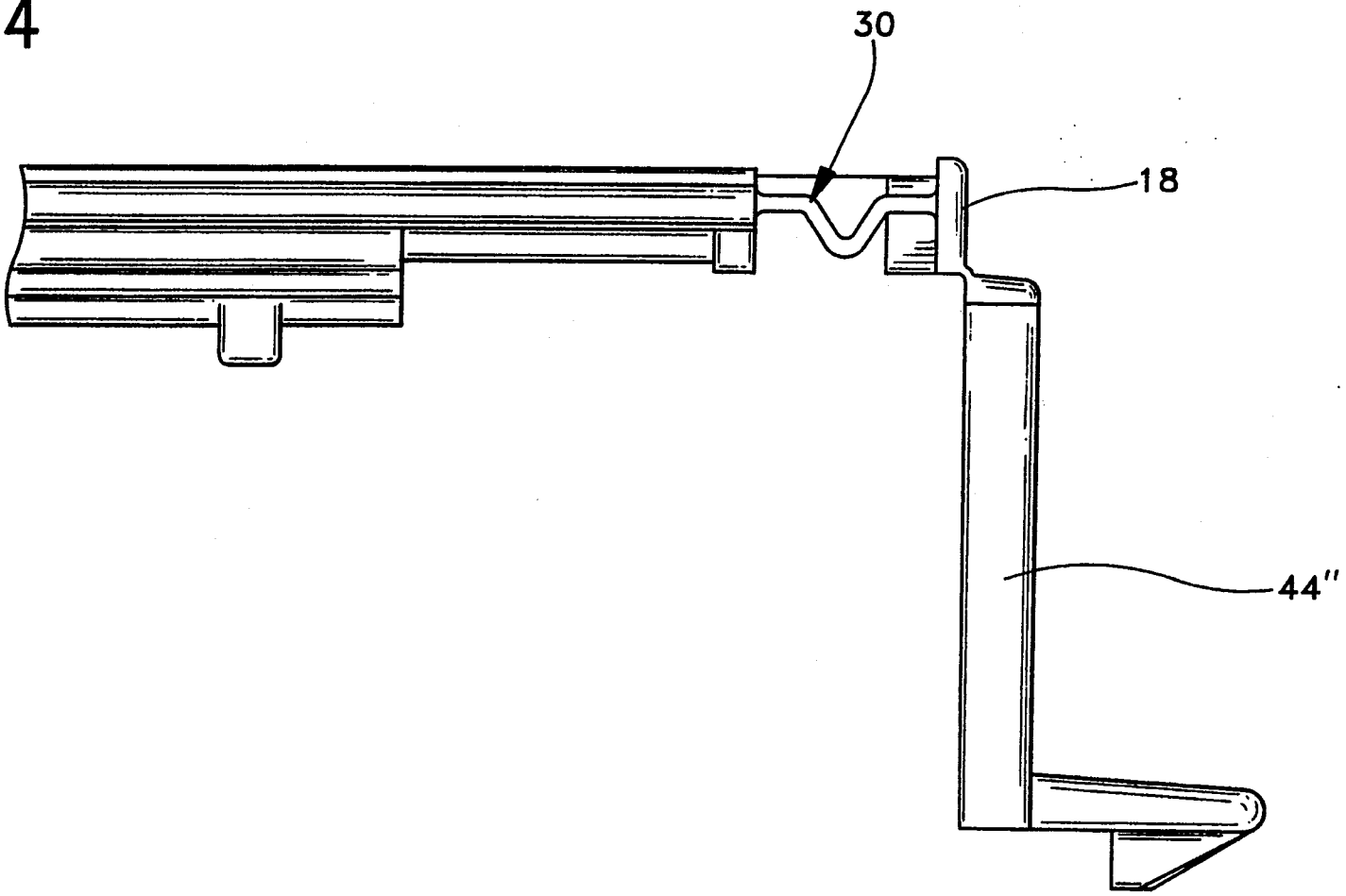
FIG. 14 is another alternative embodiment of a hinged handle-receiving bracket.

In another preferred embodiment, the handle-receiving bracket (i.e., bracket 44'') is formed in two halves, one half being hinge mounted on each end of the razor unit, as shown in FIG. 14.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. A wet-shaving razor unit for effective shaving of a contoured surface comprising:

at least one vertically-displaceable blade extending along the width of said unit; and laterally-disposed vertical return springs extending from both ends of said razor unit for movably supporting said blade, wherein said blade includes a vertically-disposed portion and an angled portion having a cutting edge for shaving, and wherein said vertically-disposed portion is encased in thermoplastic material along the longitudinal length of said blade; and wherein said laterally-disposed vertical return springs are integrally formed and continuous with said encased vertically-disposed portion of said blade.

2. The razor unit according to claim 1, wherein said laterally-disposed vertical return springs are continuous with said ends of said razor unit.

3. The razor unit according to claim 1, wherein said return springs are biased such that said springs allow vertical displacement of said blade in response to forces encountered during shaving and return said blade to a resting position in the absence of said forces.

4. The razor unit according to claim 1, wherein said cutting edge of said blade is encased with said thermoplastic material at each of its corner tips.

5. The razor unit according to claim 1, wherein said angled portion of said blade is substantially encased in said thermoplastic material.

6. The razor unit according to claim 5, wherein said cutting edge of said blade extends outward from said encased angled portion to allow shaving.

7. The razor unit according to claim 1, wherein outer ends of said vertically-disposed portion and said angled portion are encased in said thermoplastic material, and wherein said encased outer ends are integrally formed and continuous with said laterally-disposed vertical return springs.

8. The razor unit according to claim 7, wherein the cutting edge of said blade is encased in said thermoplastic material at its corner tips.

9. The razor unit according to claim 3, wherein said return springs include a flexible hinge for facilitating vertical displacement of said blade.

10. The razor unit according to claim 1, further comprising at least one shaving aid attached to a skin-engaging portion of said razor unit.

11. The razor unit according to claim 10, wherein said razor unit comprises a first shaving aid and a second shaving aid, and wherein said first shaving aid is positioned forward of said blade and said second shaving aid is positioned rearward of said blade.

12. The razor unit according to claim 10, wherein said shaving aid is a polymeric material having at least one active ingredient.

13. The razor unit according to claim 12, wherein said active ingredient is polyethylene oxide.

14. The razor unit according to claim 1, further comprising a handle-receiving bracket attached to said razor unit.

15. The razor unit according to claim 14, wherein said razor unit is formed with engaging means for receipt of and engagement with said handle-receiving bracket.

16. The razor unit according to claim 1, wherein said razor unit includes a handle-receiving bracket, and wherein said handle-receiving bracket is hinge mounted to said razor unit.

17. The razor unit according to claim 1, further comprising closure clips for enclosing said both ends of said razor unit.

18. The razor unit according to claim 16, wherein said blade is positioned such that said blade is biased by said closure clips.

19. The razor unit according to claim 18, wherein said closure clips are positioned such that said closure clips apply a downwardly-directed force to said blade such that said blade is upwardly biased.

20. The razor unit according to claim 1, further comprising a vertically-displaceable guard bar extending along the length of said unit.

21. The razor unit according to claim 1, wherein said razor unit comprises a vertically-displaceable seat blade and a vertically-displaceable cap blade.

* * * * *